United States Patent [19]

Matsubara

[11] Patent Number: 4,766,827

[45] Date of Patent: Aug. 30, 1988

[54] THREAD MEASURING AND FEEDING APPARATUS FOR A SEWING MACHINE

[76] Inventor: Toru Matsubara, 5-49-3 Fuda, Chofu-shi, Japan

[21] Appl. No.: 868,499

[22] Filed: May 30, 1986

[30] Foreign Application Priority Data

Jun. 1, 1985 [JP] Japan ..... 60-119517

[51] Int. Cl.[4] ..... D05B 47/04

[52] U.S. Cl. ..... 112/278; 112/242; 112/302

[58] Field of Search ..... 112/302, 254, 255, 278, 112/242, 241, 243, 244, 245, 250, 97

[56] References Cited

U.S. PATENT DOCUMENTS

| | | | |
|---|---|---|---|
| 4,215,641 | 8/1980 | Dobrjanskyj et al. | 112/255 X |
| 4,408,554 | 10/1983 | Takiguchi et al. | 112/302 |
| 4,566,396 | 1/1986 | Sakuma et al. | 112/302 |
| 4,590,879 | 5/1986 | Matsubara et al. | 112/242 X |
| 4,632,048 | 12/1986 | Matsubara | 112/255 X |
| 4,649,844 | 3/1987 | Matsubara | 112/302 |

FOREIGN PATENT DOCUMENTS

| | | | |
|---|---|---|---|
| 0158708 | 10/1985 | European Pat. Off. . | |
| 0189682 | 8/1986 | European Pat. Off. | 112/302 |
| 3102048 | 12/1981 | Fed. Rep. of Germany . | |
| 59-40895 | 3/1984 | Japan | 112/302 |
| 60-110210 | 5/1985 | Japan . | |
| 60-25151 | 6/1985 | Japan | 112/302 |
| 59280131 | 7/1986 | Japan . | |
| 59280132 | 7/1986 | Japan . | |
| 850858 | 10/1960 | United Kingdom . | |

*Primary Examiner*—Peter Nerbun

*Attorney, Agent, or Firm*—Armstrong, Nikaido, Marmelstein & Kubovcik

[57] ABSTRACT

An apparatus for feeding thread for a sewing machine comprising a thread feeding system for guiding the thread (14) from a spool (13) to a take-up lever (2) of the sewing machine (A). The thread feeding device is comprised of a pressure roller (10) and a feed roller (8) driven by a motor, an encoding device (17) installed on the main drive shaft of the sewing machine, an encoder (8a) for measuring the length of the thread fed, and a thread holding device (11), whereby when the encoding device (17) gives the signal to the thread holding device to release the thread, the thread feeding device feeds the thread for completing one full stitch, and the encoder (8a) actuates the thread holding device (11) to hold the thread during the stitching.

7 Claims, 3 Drawing Sheets

THREAD MEASURING AND FEEDING APPARATUS FOR A SEWING MACHINE

BACKGROUND OF THE INVENTION

This invention relates to an apparatus for feeding thread in a sewing machine. In a conventional sewing machine, a thread is fed by the reciprocating motion of a thread take-up lever. The length of thread fed is determined by the friction of a tension disc positioned in the thread pass. The tension disc is manually adjusted by an operator to match the sewing conditions.

Recent analysis of the sewing mechanism has found that the number of stitches that can be sewn depends on accurately controlling the length of thread fed into the needle. In other words, by sensing the thickness of a fabric to be sewn as well as sensing the pitch of the stitch, the length of thread that is necessary to be fed into the needle may be calculated, thus achieving automated sewing.

For example, an apparatus of this kind has already been proposed, in which the apparatus comprises a thread feed roller driven by a stepping motor, which controls the proper length of thread to be feed to the needle for every stitching motion.

In the known apparatus however, the length of thread tends to become greater than necessary due to the inertia of the apparatus. This tendency is emphasized when sewing at high speed. Furthermore, in sewing a thick fabric, the tension created in the thread is increased and therefore the stepping motor is required to have a greater capacity. This increases the manufacturing cost of the device, and makes it less competitive to market.

SUMMARY OF THE INVENTION

The primary object of this invention is to provide a thread feeding apparatus for a sewing machine in which the apparatus has a thread holding device controlled in synchronization with the sewing needle and a thread feeding device.

Another object of this invention is to provide a measuring means which, in cooperation with the thread feeding device, can feed the exact length of the thread required to form a completed stitch.

Another object of this invention is to provide an alternative sturcture of a thread holding device.

The present invention provides an apparatus for feeding thread in a sewing machine, comprising a thread feeding means for guiding the thread from a spool to a take-up lever of the sewing machine. The thread feeding means comprises a pressure roller and feed roller driven by a motor. An encoding device means is installed on the main drive shaft of the sewing machine. An encoder means measures the length of the thread fed. Also included is a thread holding device for holding or releasing the thread. The encoding device means signals the thread holding device to release the thread. The thread feeding device then feeds the thread for completing one full stitch. The encoder means then actuates the thread holding device to hold the thread during the stitching.

According to another aspect of the invention, the apparatus is provided with a thread holding device which comprises a base body disposed within a cylindrical yoke. A pair of magnets is attached to the inner surface of the cylindrical yoke. A moving coil arrangement is located between the base body and the magnets.

A friction plate is located on top of the moving coil arrangement. A cap is secured on top of the cylindrical yoke and a gap is formed between the cap and the friction plate for guiding the thread.

According to another preferred embodiment of the invention, the apparatus also contains an another thread holding device which is installed between the take-up lever and the thread feeding device. The thread holding device grips the thread before the take-up lever starts tightening the stitch.

BRIEF DESCRIPTION OF THE DRAWINGS

In the accompanying drawings, in which like references numerals designate identical parts in the several views:

FIG. 3(*b*) is a front view of the encoder;

FIG. 5(*b*) is a diagram of the of the operation of the thread holding device when sewing at high speeds;

FIG. 5(*c*) is a diagram of the operation of the threading holding device when sewing at low speeds.

DESCRIPTION OF THE PREFERRED EMBODIMENTS

The invention will now be explained by the example with reference to the drawings but is not limited hereto.

Figure 1:
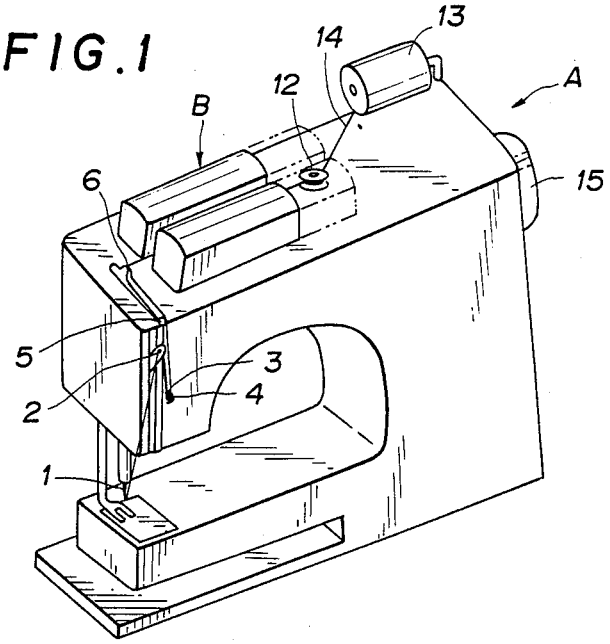
FIG. 1 is a perspective view of a sewing machine.
Figure 2:
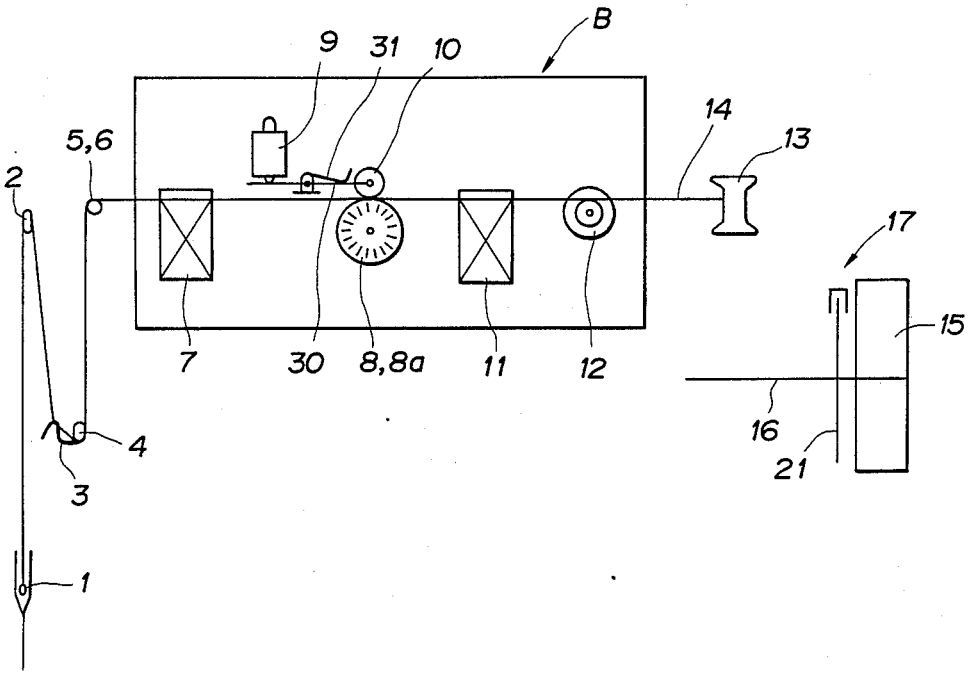
FIG. 2 is a schematic plan view of one embodiment of a thread feeding apparatus.
Figure 3A:
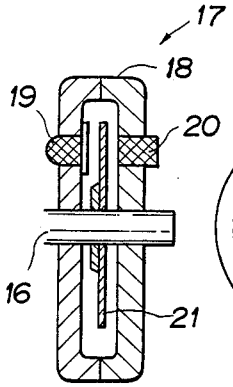
FIG. 3(*a*) is a sectional view of an encoder attached to the main shaft of the sewing machine.
Figure 3B:
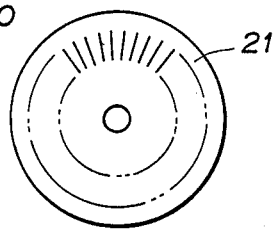

Referring to FIGS. 1–3, a sewing machines A comprises a needle 1, a thread take-up lever 2, a thread guide spring 3, thread guides 4, 5, 6, a thread holding device 7, a thread feeding control device B, a basic tension disc 12, and a spool 13. The thread 14 is fed from the spool 13 to the needle 1 through thread feeding control device B. The needle 1 and the take-up lever 2 are driven by the main drive shaft 16 of the sewing machine motor and an encoding device 17 is installed on the main drive shaft 16 of the sewing machine motor next to the pulley 15. The encoding device 17 comprises a rotatable encoding disc 21 installed in a casing 18, and a set of photo cells 19, 20. The encoding device counts the motion of the take-up lever 2 and sends signals to the thread feeding control device B.

The thread feeding control device B comprises a thread holding device 7, a feed roller 8, a pressure roller 10, an actuator 9, and another thread holding device 11.

Figure 6:
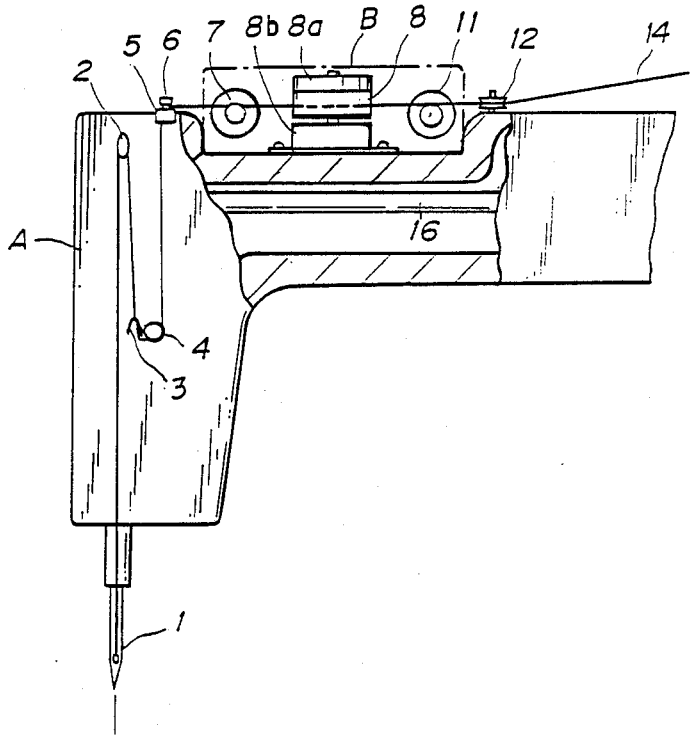
FIG. 6 is an elevated partial view of a thread holding device.

The thread feed roller 8 is driven by an electric motor 8b shown in FIG. 6, which is independent of the main drive shaft 16, and is installed with an encoder 8a on the same axis as the roller 8. The pressure roller 10 is installed at one end of a lever 30, and a spring 31 urges the roller 10 towards the feed roller 8. Installed at the other end of the lever 30 is actuator 9. When actuator 9 is activated, the lever 30 moves the pressure roller 10 away from the feed roller 8. The encoder 8a, which is installed on the same axis as the feed roller 8, measures the length of the thread fed. The encoder 8*a* is fixed on the main drive shaft of the electric motor 8*b* which drives the roller 8.

Figure 4:
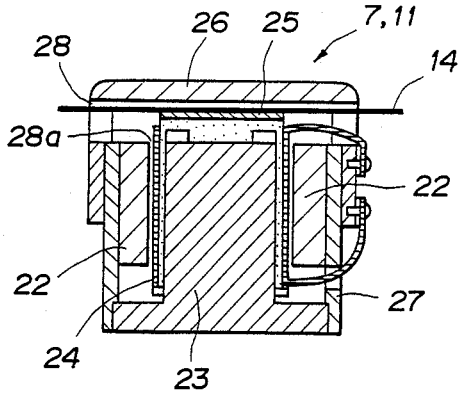
FIG. 4 is an elevational sectional view of a thread holding device.

FIG. 4 shows one embodiment of the thread holding device. The holding device 7, 11 comprise a base body 23 disposed within a cylindrical yoke 27, and a pair of magnets 22 which are attached to the inner surface of the cylindrical yoke 27. A moving coil arrangement 24 comprising a coil and a sliding element 24 with a friction plate 25 thereon. The sliding element is engaged in a gap 28*a* between the base body and the magnets 22.

A cap 26, made of an anti-magnetic material, is secured to the outer surface of the cylindrical yoke 27 and is located above the level of the friction plate 25 creating an opening 28 which allows the thread 14 to be guided therein.

The thread 14 is guided into the gap 28 of about 1 mm maintained between the rear surface of the cap 26 and the friction plate 25. The thread 14 is tightly gripped between the rear surface of the cap 26 and the friction plate 25 when the moving coil arrangement 24 is energized and is raised.

The thread 14 is released from the holding device when the coil is de-energized, so that the thread 14 can be again fed by the feed roller 8. The moving coil 24 has a small return force when de-energized to re-open the gap which allows for easy setting of the thread.

The operation of this invention will now be described using FIGS. 5(*a*), 5(*b*) and 5(*c*).

Figure 5A:
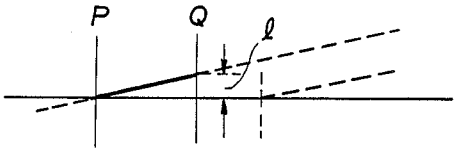
FIG. 5(*a*) is a diagram of the thread feeder.
Figure 5B:
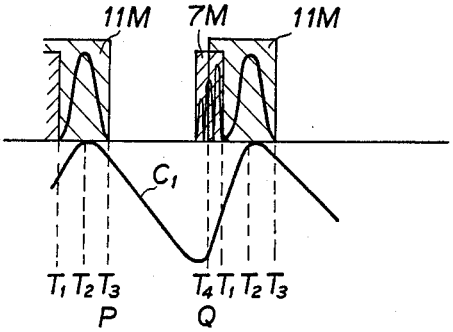
Figure 5C:
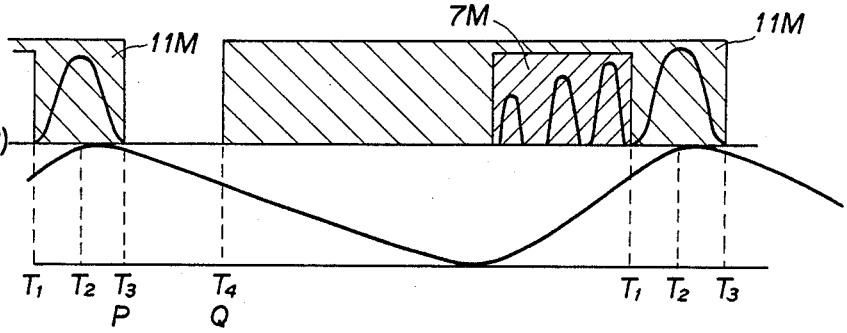

FIGS. 5(*a*) shows the timing diagram for feeding the thread. "P" is the starting point of feeding the thread, and "Q" is the stopping point of feeding the thread. Character l on the diagram shows the length of the thread fed needed to form one full stitch. In FIG. 5(*b*), curve C1 shows the motion of the thread take-up lever 2, T1 is the point where the take-up lever starts pulling up the thread to tighten the stitch, T2 is the upper dead-end of the take-up lever, and T3 is the point where the take-up lever finishes pulling the thread. T4 shows when the thread feeding is completed. In this manner, the length l of the thread 14 should be fed before the next take-up lever motion starts (T1).

The thread is fed by the constant speed of the feed roller 8. The length of thread (l) fed is measured by the encoder 8*a*. The encoder 8*a* sends a signal to the thread holding device 11 to hold thread 14. This controls the thread feeding of the sewing machine. However, when sewing at high speeds, the thread feeding device (roller, encoder) tends to over-feed the thread because the thread slips on the roller due to the take-up lever pulling the thread.

In the invention, as shown in FIG. 5(*b*) by 7M, the thread holding device 7, which is installed between the take-up lever and the feed roller 8, is engaged to grip the thread just before the take-up lever starts pulling the thread to tighten the stitch (T1). While the take-up lever is tightening the stitch, the other thread holding device 11 is engaged (11M) to grip the thread.

As described above, in the present invention, the thread is fed by a constant roller speed, and two sets of the thread holding devices grip the thread to meet the timing of the thread take-up lever to avoid over feeding the thread. In this manner, the thread is always fed accurately when sewing at high and low speeds.

I claim:

1. An apparatus for feeding thread for a sewing machine comprising:
- first motor means of said sewing machine with a main drive shaft;
- take-up lever means mounted on said sewing machine and driven by said main drive shaft; and
- thread feeding means for guiding a thread from a spool to said take-up lever means of said sewing machine, said thread feeding means including second motor means
- feed roller means rotatably driven about an axis by said second motor means,
- pressure roller means mounted such that said pressure roller means may be urged into contact with said feed roller means,
- encoding device means mounted on said main drive shaft of said sewing machine,
- encoder means for measuring the length of said thread fed, said encoder means being mounted on the axis of said feed roller means, and
- first thread holding means located in front of said pressure roller means and said feed roller means, wherein said encoding device means sends a signal to said first thread holding means to release said thread, said thread feeding means feeds said thread for completing one stitch, and said encoder means actuates said first thread holding means to hold said thread during the stitching.

2. An apparatus as claimed in claim 1, wherein a second thread holding means is positioned between said take-up lever means and said first thread feeding means, said second thread holding means grips said thread before said take-up lever means starts tightening the stitch to prevent thread tension changes.

3. An apparatus as claimed in claim 1, wherein said first thread holding means further includes a cylindrical yoke means, a gripping means disposed within said cylindrical yoke, and a cap mounted on the outer surface of said cylindrical yoke above said gripping means such that a gap is created between the gripping means and the cap to allow said thread to be guided therein.

4. An apparatus as claimed in claim 3, wherein said gripping means further includes a moving coil arrangement and a friction plate mounted on top of said moving coil arrangement.

5. An apparatus as claimed in claim 3, wherein said first thread holding means further includes a base body disposed within said cylindrical yoke, and a pair of magnets attached to the inner surface of said cylindrical yoke.

6. An apparatus as claimed in claim 4, wherein when said moving coil arrangement is energized, said friction plate is raised and said thread is tightly gripped between the rear surface of said cap and the friction plate.

7. An apparatus for feeding thread for a sewing machine comprising:
- first motor means of said sewing machine with a main drive shaft;
- take-up lever means mounted on said sewing machine and driven by said main drive shaft; and
- thread feeding means for guiding a thread from a spool to said take-up lever means of said sewing machine, said thread feeding means including second motor means,
- feed roller means rotatably driven about an axis by said second motor means,
- pressure roller means mounted such that said pressure roller means may be urged into contact with said feed roller means,
- encoding device means mounted on said main drive shaft of said sewing machine,
- encoder means for measuring the length of said thread fed, said encoder means being mounted on the axis of said feed roller means, and first thread holding means located in front of said pressure roller means and said feed roller means, wherein said encoding device means sends a signal to said first thread holding means to release said thread, said thread feeding means feeds said thread for completing one stitch, and said encoder means actuates said first thread holding means to hold said thread during the stitching, and a second thread holding means positioned between said take-up lever means and said first thread feeding means, said second thread holding means grips said thread before said take-up lever means starts tightening the stitch.

* * * * *